United States Patent [19]

D'Alterio

[11] Patent Number: 4,951,494

[45] Date of Patent: Aug. 28, 1990

[54] COMPRESSION ROLLERS WITH MOVABLE SHOULDER SHIELDS

[76] Inventor: Joseph C. D'Alterio, 64 Sugar Maple La., Glen Cove, N.Y. 11542

[21] Appl. No.: 418,535

[22] Filed: Oct. 10, 1989

[51] Int. Cl.[5] ..... B21H 1/22

[52] U.S. Cl. ..... 72/199; 384/425; 384/445

[58] Field of Search ..... 241/227-234; 72/199, 121; 384/425, 418, 419, 626; 242/76

[56] References Cited

U.S. PATENT DOCUMENTS

| | | | |
|---|---|---|---|
| 1,327,417 | 1/1920 | Barton | 387/425 X |
| 1,461,123 | 7/1923 | Johnson | 384/425 |
| 2,418,974 | 4/1947 | Henry | 72/221 X |
| 2,701,845 | 2/1955 | Gallagher et al. | 384/425 X |
| 2,996,340 | 8/1961 | Macks | 384/425 |
| 3,606,265 | 9/1971 | Cobey | 241/225 |
| 3,866,283 | 2/1975 | Gould | 72/221 X |
| 4,105,264 | 8/1978 | Zimmermann et al. | 384/419 |
| 4,363,450 | 12/1982 | Kuehn | 384/418 X |

FOREIGN PATENT DOCUMENTS

| | | | |
|---|---|---|---|
| 2092266 | 8/1982 | United Kingdom | 384/418 |

*Primary Examiner*—Timothy V. Eley
*Attorney, Agent, or Firm*—Paul W. Garbo

[57] ABSTRACT

Rolling mills commonly have rollers with shoulders abutting face plates on the frame of the mill. Dirt collects at the interface of the roller shoulders and face plates. There is no simple way to clean that interfacial area. Novel shields positioned against the roller shoulders and movable therefrom now permit facile cleaning of both the roller shoulders and shields. Frequent cleaning is critical in rolling mills of not only the food industry to prevent bacterial contamination of food products but also other industries where gritty material migrates into the interfacial area of roller shoulders and causes abrasion thereof. The shields can be as simple as stiff plastic sheets.

14 Claims, 2 Drawing Sheets

COMPRESSION ROLLERS WITH MOVABLE SHOULDER SHIELDS

BACKGROUND OF THE INVENTION

This invention relates to compression rollers having movable shoulder shields. More particularly, the invention provides rigid sheets or plates that are positioned against the opposite ends or shoulders of the rollers and that can be moved to permit cleaning of the interfacial area of the roller shoulders and rigid sheets.

Rolling mills that crush or compress materials are used in processing numerous materials as diverse as metals, plastics, grapes and edible dough. In such operations, some materials will exude liquid and other materials will give off fine powders. Inevitably, liquid and fine powder from the material undergoing compression by the rollers migrate to and down along the shoulders of the rollers.

In the conventional design of rolling mills, the shoulders of the rollers abut face plates that are fixed parts of the rolling mill frame. Hence, liquid and debris entering the interfaces of the roller shoulders with the face plates cannot be removed without first disassembling part of the rolling mill. This is a serious problem when the rolling operation generates a gritty powder that will cause grinding and wear at the interfaces. It is a particularly serious problem where food products such as pasta and baking dough undergo rolling because the material collecting in the interfaces becomes a source of bacterial contamination of the food product passing through the rollers. Hence, it becomes mandatory in some rolling operations, especially in food processing, to clean the interfaces of the rollers frequently, e.g., daily or even more often.

A principal object of this invention is to provide movable shields between the shoulders of the rollers and the face plates of a rolling mill.

A further object is to provide shields that offer low frictional resistance to the abutted roller shoulders.

Another important object is to provide shields that are easily moved into abutment with roller shoulders and away therefrom when desired.

Other features and advantages of the invention will be apparent from the description which follows.

SUMMARY OF THE INVENTION

In accordance with this invention, a rigid sheet of low frictional resistance to metal, usually a plastic such as nylon or Delrin offered by DuPont, is positioned against the shoulders of two or more compression rollers. A feature of the invention is that the rigid sheets or shields at the opposite ends of the rollers are easily moved away from the roller shoulders whenever it is desired to clean the interfacial area of each shield with the roller shoulders.

In its simplest embodiment, each shield is a panel that is split in two parts along the line that passes through the centers of the axles of the compression rollers. Each of the two parts of the shield has a semi-circular cutout to fit around the axle at each end of each roller. Hence, the two parts of each shield, when brought together, will have a circular opening to fit each axle of each roller. The edges of the two parts of a shield that abut one another when the parts are brought together are preferably shaped, e.g., as a mortise and tenon, to impede the seepage of slime through the joint between the two parts of the shield.

In the preferred embodiment, each shield is a unitary panel with circular holes to fit the axles of the compression rollers. In this embodiment, the shoulder at each end of each roller is spaced from the face plate of the rolling mill by a distance greater than the thickness of the shield. Wedging means between the face plate and the shield are used to press the shield against the shoulders of the rollers. When it is desired to clean the interfacial areas of the roller shoulders and the shield, the wedging means are removed, inactivated or released so that the shield can be easily moved away from the roller shoulders toward the face plate. After the roller shoulders and the shield have been cleaned, the shield is simply pushed against the roller shoulders and locked in contact therewith by returning or reactivating the wedging means between the shield and face plate of the rolling mill. The wedging means may be in any form that will keep the shield pressed against the roller shoulders. While simple wedges are adequate in many cases, more sophisticated means are generally used particularly in large rolling means. For example, if the shield has threaded holes with screws therein that extend to the face plate, the screws can be turned to push the shield away from the face plate (like opening a vise) until the shield is firmly against the roller shoulders.

BRIEF DESCRIPTION OF THE DRAWINGS

To facilitate the further description and understanding of the invention, reference will be made to the accompanying drawings in which.

DESCRIPTION OF PREFERRED EMBODIMENTS

Figure 1:
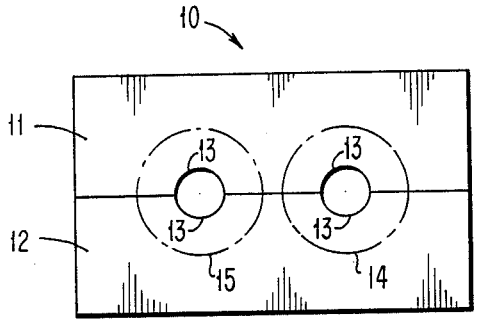
FIG. 1 shows the face of a two-part shield that contacts a pair of compression rollers.

FIG. 1 shows a simple embodiment of the invention as a split or two-part shield 10 having upper part 11 and lower part 12. Each of parts 11,12 has a semi-circular cutout 13 for each axle of the rolling mill on which shield 10 will be mounted. The opposed cutouts 13 of parts 11,12 form circular openings that are dimensioned to fit the axles of the compression rollers of the mill. The dotted circles 14,15 indicate the circumscribed areas that would be in contact with the ends or shoulders of a pair of rollers when shield 10 is installed in the rolling mill.

Figure 2:
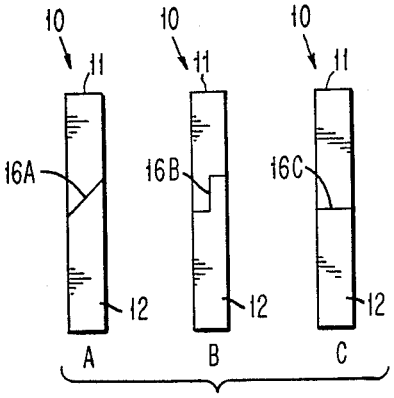
FIG. 2 is a right end view of the shield of FIG. 1, showing three variations of the joint between the two parts of the shield.

FIG. 2 is a right end view of shield 10 of FIG. 1 showing three variations of the juncture between top part 11 and bottom part 12. Shield 10 of FIG. 2A has juncture 16A which slopes upward from the face of shield 10 that presses against the shoulders of the compression rollers. On FIG. 2B, juncture 16B is in the form of an ascending step relative to the shield face that contacts the roller shoulders. Junctures like 16A and 16B offer more resistance to the seepage therethrough of debris and slime that may collect between shield 10 and the roller shoulders than does the flat juncture 16C of FIG. 2C where parts 11,12 are abutted at their edges which are at right angles to the faces of shield 10. However, in most cases the seepage of dirt through the juncture of two-part shield 10 is unimportant because when shield 10 is removed from the rolling mill the face plate can be readily cleaned while cleaning the roller shoulders.

Figure 3:
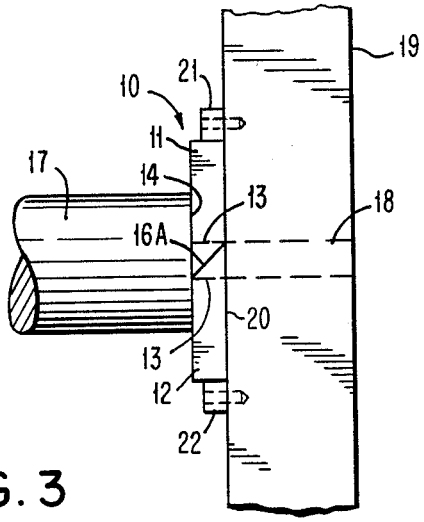
FIG. 3 is a partial elevation of a rolling mill equipped with the shield of FIG. 1 and FIG. 2A.

FIG. 3 is a partial elevation of a rolling mill in which roller 17 has its axle 18 supported in frame upright 19 of the mill. Parts 11, 12 of shield 10 have been snuggly fitted between the shoulders of roller 17 and a parallel roller (not visible) and face plate 20 of upright 19. The interfacial contact area between the shoulder of roller 17 and shield 10 is designated by numeral 14. It is evident in FIG. 4 that juncture 16C between shield parts 11,12 slopes upwardly from interface 14 to face plate 20. After part 11 has been pushed down between the pair of rollers (only 17 visible) and face plate 20 until semi-circular cutouts 13 contact the axles (only 18 indicated) of these rollers, bar 21 extending over a substantial portion of the top edge of part 11 is screwed or otherwise fastened to frame upright 19 to keep part 11 from moving upwardly during the rotation of the rollers.

After shield part 12 has been pushed up between the pair of rollers (only 17 visible) and face plate 20 until semi-circular cutouts 13 contact the axles (only 18 indicated) of these rollers, bar 22 extending over a substantial portion of the bottom edge of part 12 is screwed or otherwise fastened to frame upright 19 to keep part 12 from moving downwardly during the rotation of the rollers. As an alternative way for holding shield parts 11,12 in the desired position, screws may pass through parts 11,12 into upright 19.

FIG. 3 shows the right end portion of roller 17 and the support structure for its axle 18. The left end portion of roller 17 and its support structure is simply a mirror image of FIG. 3. It is also understood in FIG. 3 that a second roller like roller 17 is positioned in back of, and parallel to roller 17 so that the second roller is not visible.

Figure 5:
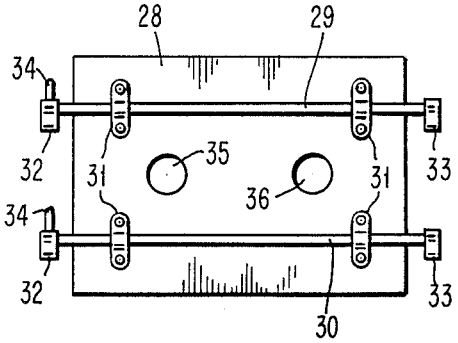
FIG. 5 shows the face of the shield in FIG. 4 that does not contact the rollers.
Figure 4:
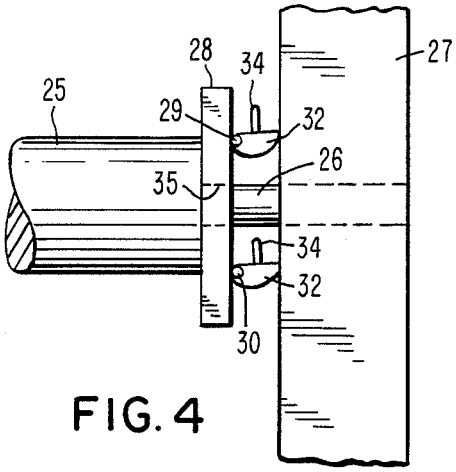
FIG. 4 is a partial elevation like FIG. 3 of a rolling mill equipped with a unitary shield.

FIG. 4 is a partial elevation of a rolling mill in which roller 25 has its axle 26 supported in frame upright 27 of the mill. The back face of unitary shield 28 is shown in FIG. 5. Two metal rods 29,30 are held against the back face of shield 28 by saddle clamps 31 which are screwed to shield 28. The opposite ends of rods 29,30 have cam-shaped disks 32,33 fastened thereon. As shown in FIG. 4, cam disks 32 as well as cam disks 33 (not visible in FIG. 4) are locked in the position that presses shield 28 against the end or shoulder of roller 25 and against the shoulder of a second roller like roller 25 which is parallel to, and in back of, roller 25. Cam disks 32 have handles 34 affixed thereto. Shield 28 has two circular holes 35,36 which are just large enough for axle 26 to pass through hole 35 and for the axle like axle 26 of the second roller to pass through hole 36.

When a counterclockwise force is applied to handles 34 to cause a rotation of 180° of rods 29,30 as viewed in FIG. 4, cam disks 32,33 are swung completely away from frame upright 27. At that position, handles 34 will point vertically downward in contrast to the vertically upward direction of handles 34 shown in FIG. 4. With handles 34 pointing downward, cam disks 32,33 have been turned completely away from upright 27 so that shield 28 can be manually pushed away from the shoulders of roller 25 and the parallel roller (not visible) until saddle clamps 31 on the back face of shield 28 are against upright 27. Now it is easy to clean the exposed roller shoulders as well as the face of shield 28 which is in pressing contact with the roller shoulders when the compression rollers are rotating.

After cleaning has been completed, shield 28 is again manually moved until it is against the roller shoulders; thereupon, the downwardly pointed handles 34 are manually forced clockwise 180° so that handles 34 point upwardly as shown in FIG. 4. Consequently, cam disks 32 are locked in pressing contact against upright 27 to ensure that shield 28 is held firmly against the roller shoulders. When cam disks 32,33 have been turned completely away from frame upright 27, shield 28 which has two roller axles extending through circular holes 35,36 is not only supported by these axles but also slides smoothly thereon when moved from the locked or closed position shown in FIG. 4 or from the opposite open position which has already been described. Of course, it is understood that the opposite ends of roller 25 and the roller parallel thereto are also equipped with a movable unitary shield; the appearance of the left side of the rolling mill is merely the mirror image of FIG. 4.

Figure 6:
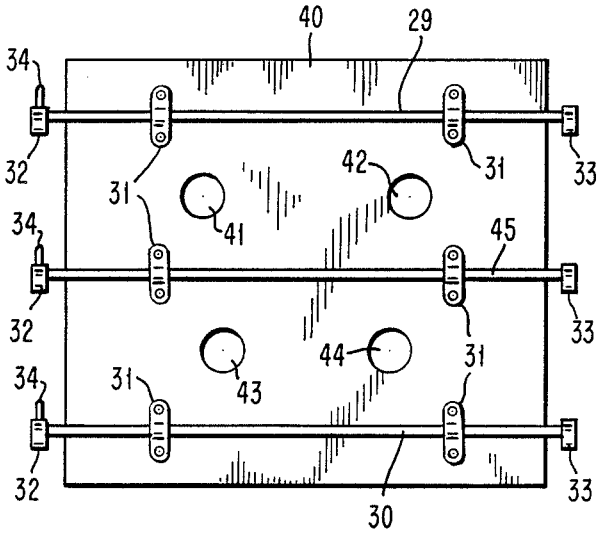
FIG. 6 is an elevation like FIG. 5 of a shield for a rolling mill having two pairs of rollers.

FIG. 6 like FIG. 5 shows the back face of another unitary shield 40 for a rolling mill that has an upper pair of rollers and a lower pair of rollers. Circular openings 41, 42 to receive the axles of the upper pair of rollers are spaced from one another more than are circular openings 43,44 to receive the axles of the lower pair of rollers. As known, the nip between the two upper rollers is wider than the nip between the two lower rollers. Thus, a plastic mass dropped on the upper rollers is formed into a sheet by the counter-rotating upper rollers and that sheet drops into the narrower nip of the lower rollers, issuing therefrom as a sheet of reduced thickness.

Like shield 28 of FIG. 5, shield 40 is equipped with metal rods 29,30 that are held thereon by saddle clamps 31. When handles 34 on cam disks 32 are used to turn disks 32 to the locking or open position as already explained, rods 29, 30 and cam disks 33 are, of course, simultaneously also turned. Hence, rods 29,30 transmit the rotary movement of cam disks 32 to cam disks 33. In addition, metal rods 29,30 serve to strengthen shield 40 against bending or flexing away from the flat form that is desired for the shields of this invention. Because of its large size, it is advisable to further strengthen shield 40 with another metal rod 45 fastened thereto by saddle clamps 31 midway between rods 29,30. Rod 45 also has cam disks 32,33 attached to its opposite ends.

FIG. 6 is illustrative of a unitary shield for a rolling mill with a stack of two pairs of counter-rotating rollers. However, the principles thereof are applicable to shields for rolling mills with stacks of three or more pairs of rollers.

The locking means shown in FIGS. 4 and 5 for holding shield 28 against the shoulder of roller 25 may take various forms other than cam disks 32,33 mounted on rods 29,30. For example, simple wedges may be pressed into the space between shield 28 and upright 27. Another locking means may be bolts that can be turned in threaded holes in shield 28 so that the lead ends of the bolts will extend across the space between shield 28 and upright 27 and ultimately press against upright 27. The pressure created by the bolts against upright 27 will force shield 28 to press with equal force against the shoulders of roller 25 and the roller parallel thereto.

Many other forms of locking means will be obvious to mechanical workers.

While the rollers of most rolling mills are cylindrical, there are some mills for special uses that have rollers with surfaces that are not cylindrical. For example, rolling mills designed to knead bread or pasta dough may include rollers with corrugated or gear-like surfaces. The shields of this invention, whether of the split or unitary type, are applicable to all rolling mills regardless of the cross-sectional contour of the rollers.

Split or two-part shields are readily removed from the rolling mill when it is desired to clean the roller shoulders and shields. Unitary shields can only be moved axially away from the roller shoulders when it is time to clean them. To remove unitary shields involves a major disassembly of the rolling mill.

The shields of this invention may be made of any rigid material that offers low frictional resistance to rotating roller shoulders in pressing contact therewith. The shield may have a metal plate as backing to provide strength and stiffness to the material of low frictional resistance that contacts the roller shoulders. For example, a layer of DuPont's Teflon (a fluorocarbon polymer) backed by a metal plate provides a suitable shield. Enameled steel may be another shield material. A glass plate may be still another shield material. In general, plastics are preferred because of physical properties, machinability and cost. Nylon and Delrin are particularly preferred plastics for use as shields. In fact, Delrin in sheets of about 0.5 to 1.5 inches in thickness have performed successfully as shields in rolling mills with stacked multiple pairs of rollers used in the manufacture of pasta products. Delrin sheets of at least about 0.5 inch thickness do not require a metal plate as backing to provide stiffness; metal rods such as rods 29,30,45 in FIGS. 5 and 6 can provide adequate strength. DuPont's Delrin is an acetal resin.

Several variations and modifications of the invention have been presented but many others will be apparent to those skilled in the art without departing from the spirit or scope of the invention. Accordingly, only such limitations should be imposed on the invention as are set forth in the appended claims.

What is claimed is:

1. In a rolling mill having at least one pair of compression rollers, each of said rollers having a shoulder and an axle at its opposite ends, the improvement of a movable shield abutted against the shoulders at each of the opposite ends of said rollers, each said shield having at least one pair of circular openings in which the axles of said rollers are fitted and being a flat stiff plate of which at least the face that abuts said shoulders of said rollers is a material offering low frictional resistance to the rotation of said rollers.

2. The improvement of claim 1 wherein the material of low frictional resistance is a plastic.

3. The improvement of claim 2 wherein the plastic is selected from the group consisting of nylon and acetal resin.

4. The improvement of claim 1 wherein each shield is split in two parts along a line passing through the centers of the axles of the rollers, each of said two parts having a semi-circular cutout at said line to fit each of said axles.

5. The improvement of claim 4 wherein the split of the two parts of each shield is not at right angles to the face thereof.

6. The improvement of claim 5 wherein the material of low frictional resistance is a plastic.

7. The improvement of claim 1 wherein each shield is a unitary plate with circular openings to fit the axles of the rollers, each said shield being supported by, and slidable along, said axles, and wherein each said shield has releasable locking means for holding said shield abutted against the shoulders of said rollers.

8. The improvement of claim 7 wherein each shield is a stiff plastic plate reinforced by at least two spaced metal rods attached to the back of said plastic plate.

9. The improvement of claim 8 wherein the metal rods are rotatable and part of the locking means.

10. The improvement of claim 9 wherein the stiff plastic plate is formed of nylon or acetal resin and is at least about 0.5 inch thick.

11. The improvement of claim 7 wherein the material of low frictional resistance is a plastic.

12. The improvement of claim 7 wherein the locking means for each shield is attached to the back of said shield.

13. The improvement of claim 12 wherein each shield is a stiff plastic plate reinforced by at least two spaced metal rods attached to the back of said plastic plate.

14. The improvement of claim 13 wherein the stiff plastic plate is formed of nylon or acetal resin.

* * * * *